US006807707B2

(12) United States Patent
Park et al.

(10) Patent No.: US 6,807,707 B2
(45) Date of Patent: Oct. 26, 2004

(54) AIR EXHAUST STRUCTURE FOR AN UPRIGHT-TYPE VACUUM CLEANER

(75) Inventors: Jung-seon Park, Gwangju (KR); Il-won Yang, Gwangju (KR); Hyung-il Jeon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 331 days.

(21) Appl. No.: 10/139,699

(22) Filed: May 1, 2002

(65) Prior Publication Data

US 2003/0145419 A1 Aug. 7, 2003

(30) Foreign Application Priority Data

Feb. 5, 2002 (KR) ..... 2002-6465

(51) Int. Cl.[7] ..... A47L 9/10; A47L 9/12

(52) U.S. Cl. ..... 15/347; 15/351

(58) Field of Search ..... 15/347, 350, 351, 15/352; 55/429, DIG. 3

(56) References Cited

U.S. PATENT DOCUMENTS 4,885,013 A * 12/1989 Ahlf et al. ..... 55/367
5,145,499 A * 9/1992 Dyson ..... 55/337
5,867,863 A * 2/1999 McCormick ..... 15/351
5,946,771 A * 9/1999 Bosyj et al. ..... 15/347
5,961,676 A * 10/1999 King et al. ..... 55/334
6,609,270 B2 8/2003 Kim
2002/0166200 A1 * 11/2002 Conrad et al. ..... 15/353
2003/0208878 A1 * 11/2003 Alford et al. ..... 15/339

FOREIGN PATENT DOCUMENTS

DE 3404395 8/1985
GB 2358126 7/2001

* cited by examiner

*Primary Examiner*—Terrence R. Till
(74) *Attorney, Agent, or Firm*—Ladas & Parry LLP

(57) ABSTRACT

An air exhaust structure for an upright-type vacuum cleaner capable of a convenient use by providing a filter cover which is not easily opened by a discharging pressure of the air, while the filter cover is easily opened and closed by the user. The air exhaust structure of an upright-type vacuum cleaner has a frame having a duct formed at a side of the cleaner body to communicate with the motor driving chamber, a support member protruded from an inside wall of the duct, a filter, a filter cover having a grill portion disposed at the frame; and a removable means for opening and closing the filter cover. The removable means includes a hook formed at a front end of the filter cover and a locking hole having a locking protrusion disposed at the frame placed at a corresponding position of the hook. The hook includes a fixing portion extended from the filter cover, a flexible pressing portion bent in a direction approximately 180° from the fixing portion, and a pair of protrusions disposed at both sides of the flexible pressing portion and connected with the locking protrusion of the locking hole.

4 Claims, 6 Drawing Sheets

AIR EXHAUST STRUCTURE FOR AN UPRIGHT-TYPE VACUUM CLEANER

BACKGROUND OF THE INVENTION

1. Field of the Invention

The present invention relates generally to a vacuum cleaner, and more particularly, to an air exhaust structure for an upright-type vacuum cleaner.

2. Description of the Related Art

As shown in FIG. 1, a conventional upright-type vacuum cleaner comprises a suction brush 20 disposed at a lower part of a cleaner body 10 that moves over a surface to be cleaned. The cleaner body 10 comprises a dust-collection chamber 11 disposed at an upper part thereof, and a motor driving chamber 12 disposed at a lower part thereof. A dust filter (not shown) is removably disposed in the dust-collection chamber 11, and a motor (not shown) is disposed in the motor driving chamber 12.

In the conventional upright-type vacuum cleaner having the above structure, when the motor is driven, a strong suction force is generated by the suction brush 20. Air, including entrained dust and dirt that existed on the surface to be cleaned, is drawn into the cleaner body 10 through the suction brush 20 by the suction force. The drawn air is discharged to the motor driving chamber 12 after passing through the dust filter disposed at the dust-collection chamber 11 of the cleaner body 10. At this time, the dust and dirt entrained in the drawn in air is collected by the dust filter, and the rest of the drawn air is discharged to the outside through the motor driving chamber 12.

The air discharged to the outside should be clean (not having the dust and the dirt), and should be easily discharged. For this purpose, the upright-type vacuum cleaner has an air exhaust structure 30.

One example of the air exhaust structure of the upright-type vacuum cleaner is shown in FIGS. 2 and 3. The air exhaust structure of the upright-type vacuum cleaner as shown in these figures comprises: a frame 32 having a duct 31 formed at a side of the cleaner body 10 in a lengthwise direction in order to communicate with the motor driving chamber 12; a support member 33 protruding from an inside wall of the duct 31; a filter 34 for being embraced in the duct 31; a filter cover 35 having a grill portion 35*a* disposed in the frame 32, for being rotated to open, and close the duct 31; and a removable means 40 for opening and closing the filter cover 35.

The means 40 for opening and closing is integrally formed approximately at the center of the front end of the filter cover 35. The means 40 for opening and closing includes a hook 41, seen in profile in FIG. 3, having a protrusion 41*a* at an end, a locking hole 42 having a locking protrusion 42*a* formed at the frame 32 placed at a position corresponding to the position of the hook 41, and an opening handle 43 disposed at a hook forming area of the filter cover 35.

The air discharged from the motor driving chamber 12 is drawn into the duct 31, and the air is again discharged to the outside through the filter 34 and the grill portion 35*a* of the filter cover 35. At this time, the dust and dirt entrained in the air is filtered by the filter 34. When the cleaner is used in a long time, the dust and dirt stuck in the filter 34 will clog the filter, thus the air is not smoothly discharged. Therefore, the filter 34 should be periodically separated for cleaning or changing. When the filter 34 is changed, a user pulls the opening handle 43 of the filter cover 35. Then, the protrusion 41*a* of the hook 41 is released from the locking protrusion 42*a* of the locking hole 42, and the filter cover 35 is opened. The filter 34 is separated from the duct 31 and a new filter is inserted. After the filter 34 is changed, the filter cover 35 is closed. Then, the protrusion 41*a* of the hook 41 is locked with the locking protrusion 42*a* of the locking hole 42, and the filter cover 35 is retained in a closed position.

However, in the air exhaust structure of the above-described conventional upright-type vacuum cleaner, as the protrusion 41*a* of the hook 41 formed at the filter cover 35 retains the closing state of the filter cover 35 closed by the protrusion 41*a* is forcibly connected with the locking protrusion 42*a* of the locking hole 42 formed at the frame 32, great force is required, when the filter cover 35 is opened and closed for changing the filter 34, thus the opening and the closing of the filter cover 35 is difficult. In other words, when the filter cover 35 is opened, the protrusion 41*a* of the hook 41 is released from the locking protrusion 42*a* of the locking hole 42 and the filter cover 35 is opened only when a sufficient force, strong enough to overcome the self elasticity of these combined elements, is applied. In addition, when the filter cover 35 is closed, the protrusion 41*a* of the hook 41 is locked with the locking protrusion 42*a* of the locking hole 42 and the filter cover 35 is closed only when a sufficient force, which is strong enough to overcome the self elasticity of these combined elements, is applied. Accordingly, opening and closing of the filter cover 35 are difficult.

Furthermore, when the above-described filter cover 35 is opened and closed, there is a possibility that the protrusion 41*a* of the hook 41 and the locking protrusion 42*a* of the locking hole 42 can be broken as strong force is applied to the hook 41. Moreover, connection of the protrusion 41*a* of the hook 41 and the locking protrusion 42*a* may become weakened due to the abrasion of the elements, thus there is a problem that the filter cover 35 might be opened by the pressure of the air discharged while the user is using the vacuum cleaner.

SUMMARY OF THE INVENTION

An object of the present invention is to provide an air exhaust structure for an upright-type vacuum cleaner capable of improving the convenience of a user by providing a filter cover which is not easily opened by the discharging pressure of the air, while the filter cover is easily opened and closed by the user.

The above object is accomplished by providing an air exhaust structure for an upright-type vacuum cleaner comprising: a frame having a duct formed at a side of the cleaner body, preferably in a lengthwise direction, in order to communicate with the motor driving chamber; a support member protruded from an inside wall of the duct; a filter; a filter cover having a grill portion disposed at the frame; and a removable means for opening and closing the filter cover.

The removable means preferably includes: a hook formed at a front end of the filter cover; and a locking hole having a locking protrusion disposed at the frame placed at a position corresponding to the position of the hook. In addition, the hook includes: a fixing portion extended from the filter cover; a flexible pressing portion bent in a direction approximately 180° from the fixing portion; and a pair of protrusions disposed at both sides of the flexible pressing portion and connected with the locking protrusion of the locking hole.

According to the preferred embodiment of the present invention, in the air exhaust structure for the upright-type vacuum cleaner, at least one hook is disposed at a front end of the filter cover in a predetermined interval.

Moreover, a cut away portion is formed at the fixing portion and a bent portion of the flexible pressing portion in order to increase the elasticity of the flexible pressing portion.

Accordingly, the filter cover is maintained in a closed position since the protrusion of the flexible pressing portion disposed at the hook of the filter cover is flexibly engages the locking protrusion of the locking hole disposed at the frame, thus the filter cover is not opened by the discharging pressure of the air. In addition, the opening and the closing of the filter cover is easily operated, as the filter cover is opened by releasing the engagement between the protrusion of the flexible pressing portion and the locking protrusion of the locking hole, with a simple method of pressing the flexible pressing portion of the hook.

BRIEF DESCRIPTION OF THE DRAWINGS

The object and features of the present invention will be more apparent by describing the preferred embodiment of the present invention by referring to the appended drawings, in which.

DETAILED DESCRIPTION OF THE PREFERRED EMBODIMENT

The preferred embodiment of the present invention will be described in greater detail by referring to the appended drawings.

Figure 1:
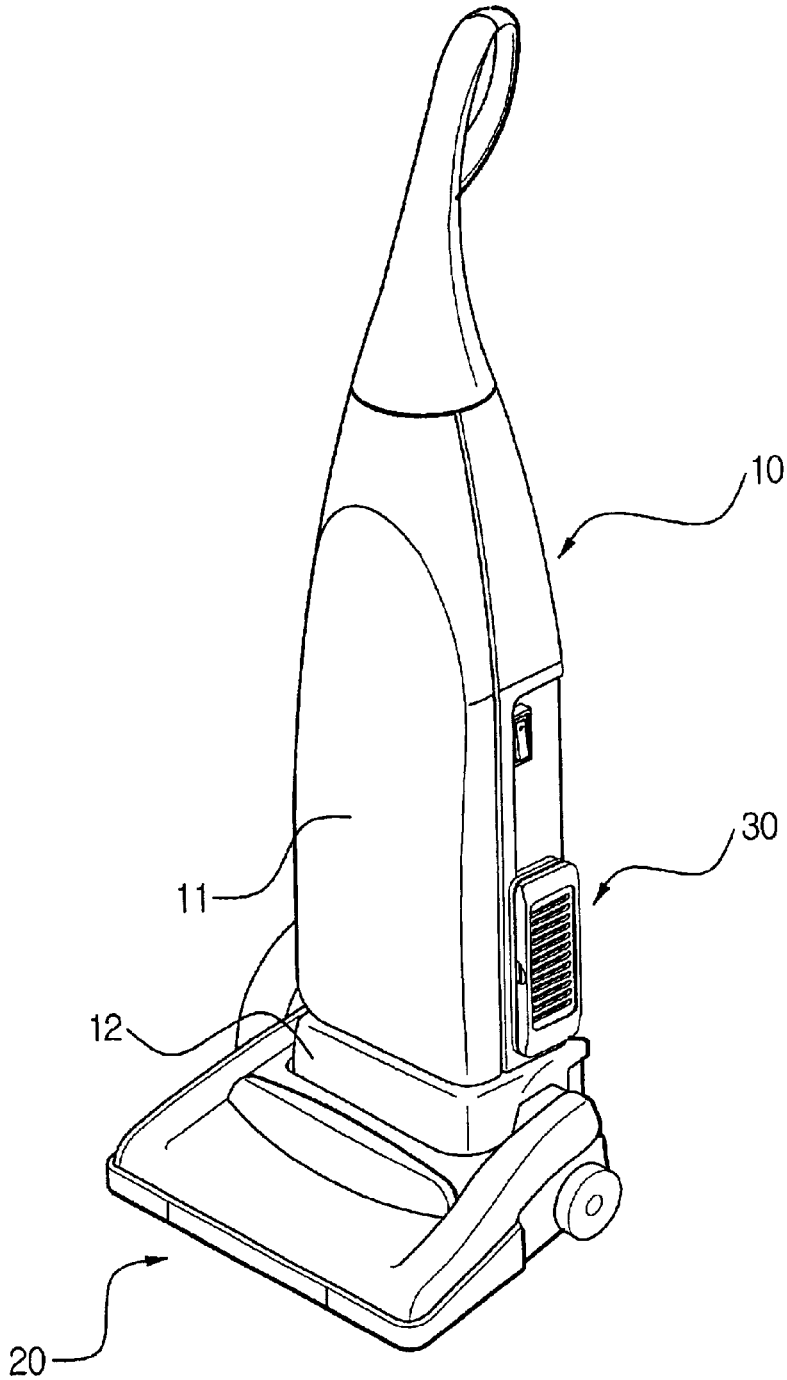
FIG. 1 (PRIOR ART)
FIG. 1 is a perspective view showing an appearance of a conventional upright-type vacuum cleaner.
Figure 2:
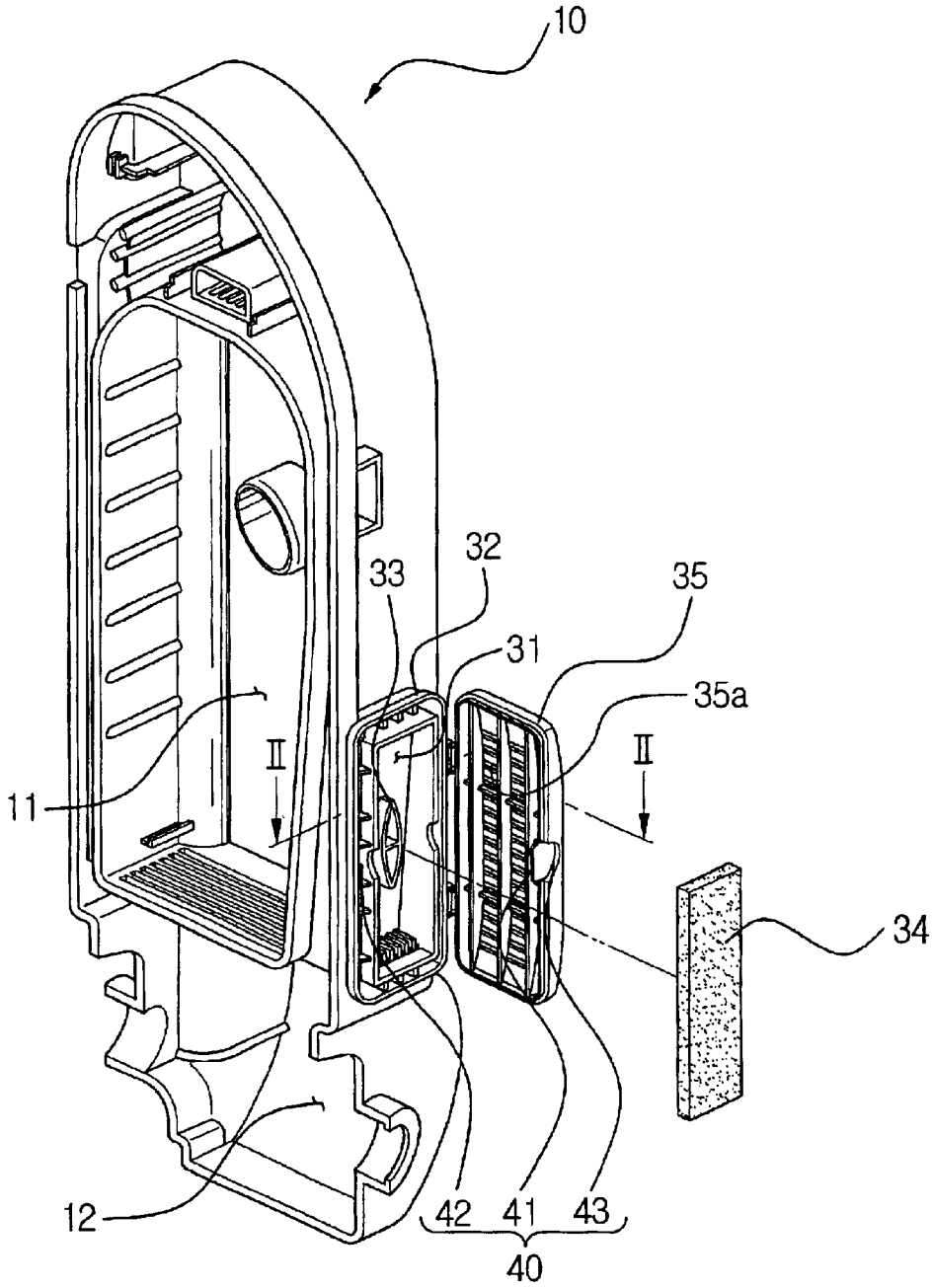
FIG.2 (PRIOR ART)
FIG. 2 is a perspective view showing an air exhaust structure of the conventional upright-type vacuum cleaner.
Figure 3:
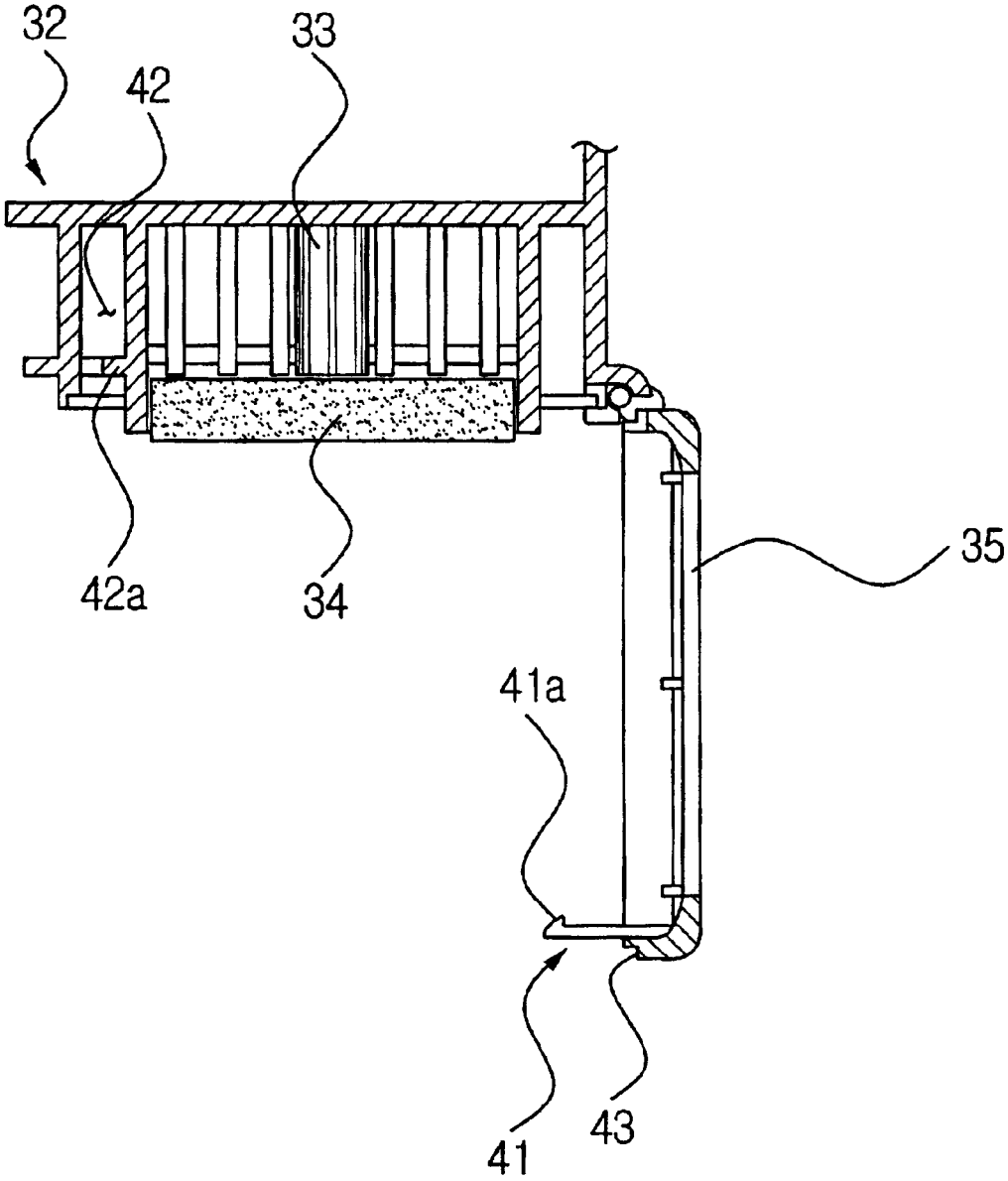
FIG.3 (PRIOR ART)
FIG. 3 is a sectional view taken approximately along a line II—II of FIG. 2.
Figure 4:
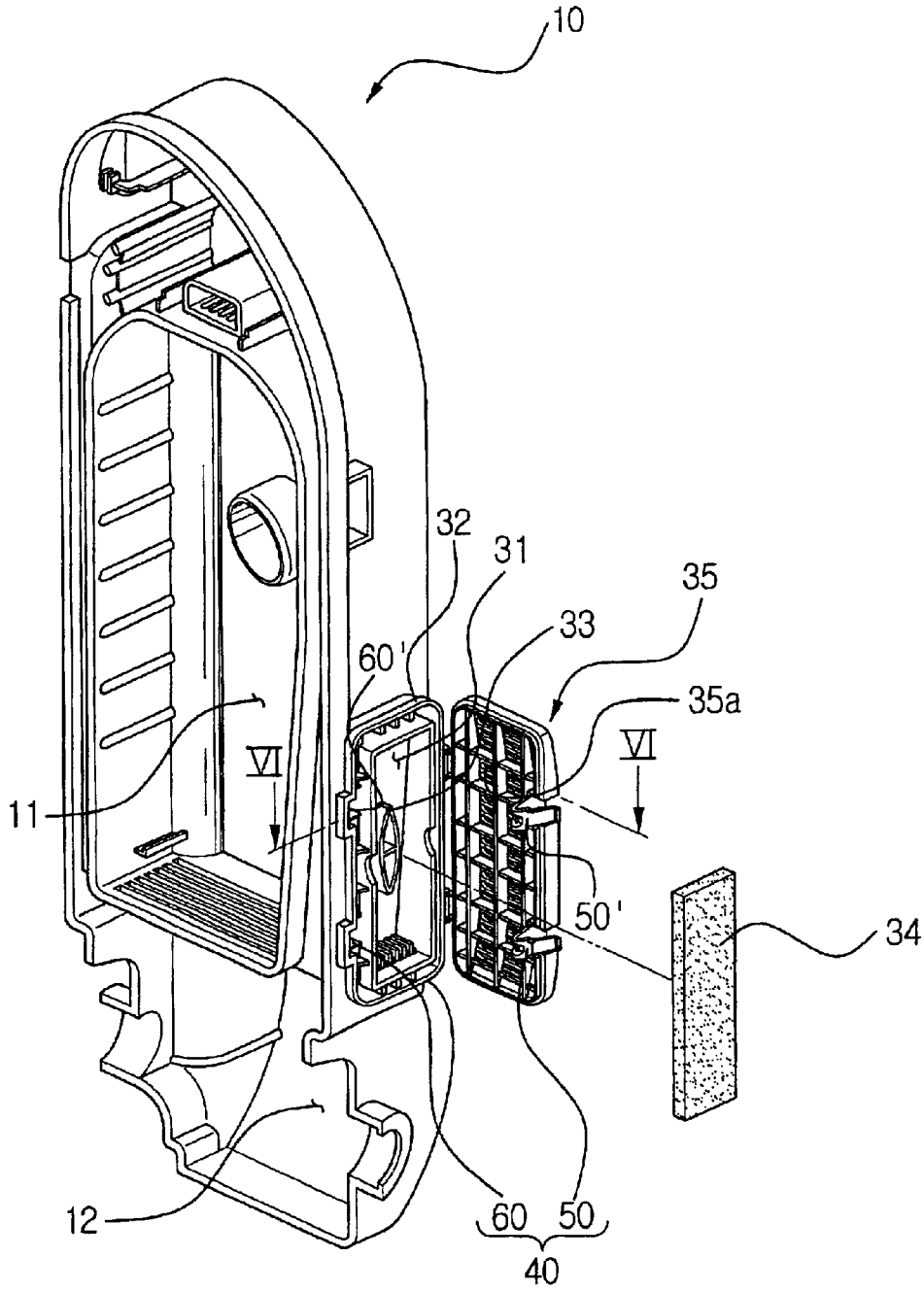
FIG. 4 is a perspective view showing an air exhaust structure for an upright-type vacuum cleaner according to the preferred embodiment of the present invention.
Figure 5:
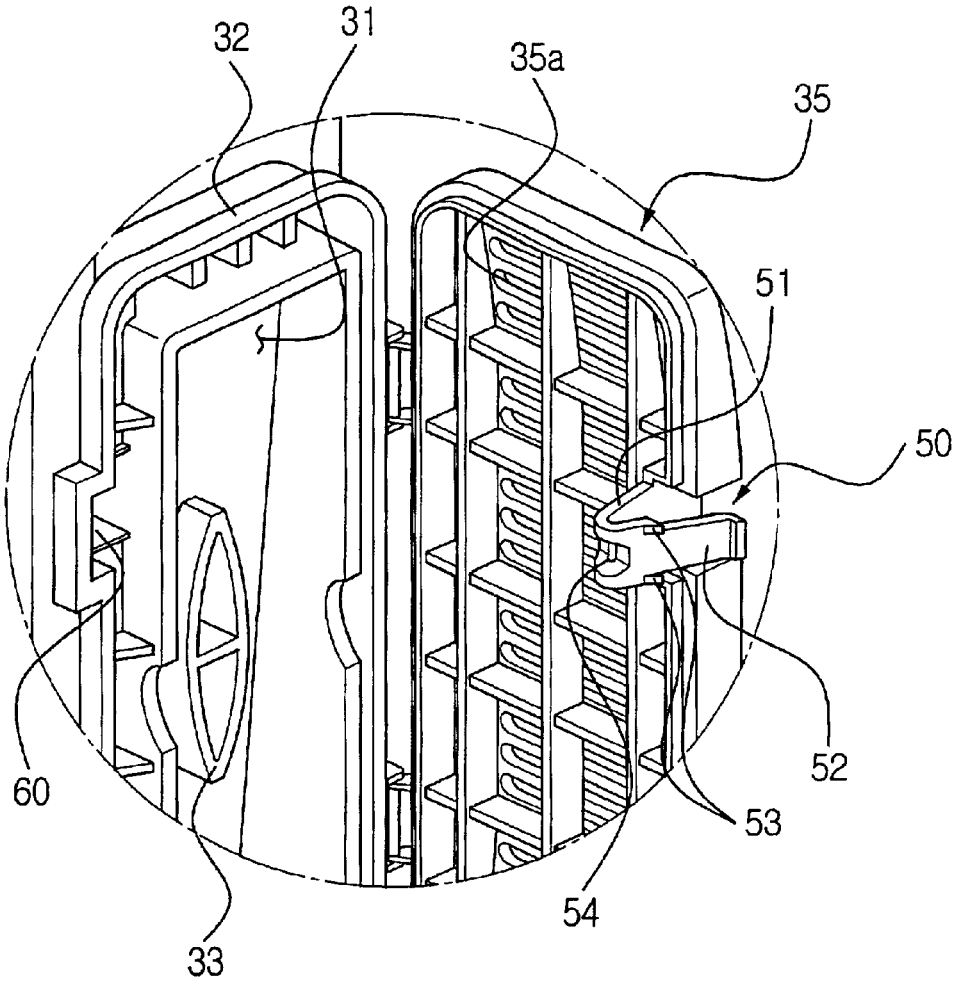
FIG. 5 is an enlarged detail view showing a part of FIG. 4 in greater detail.
Figure 6:
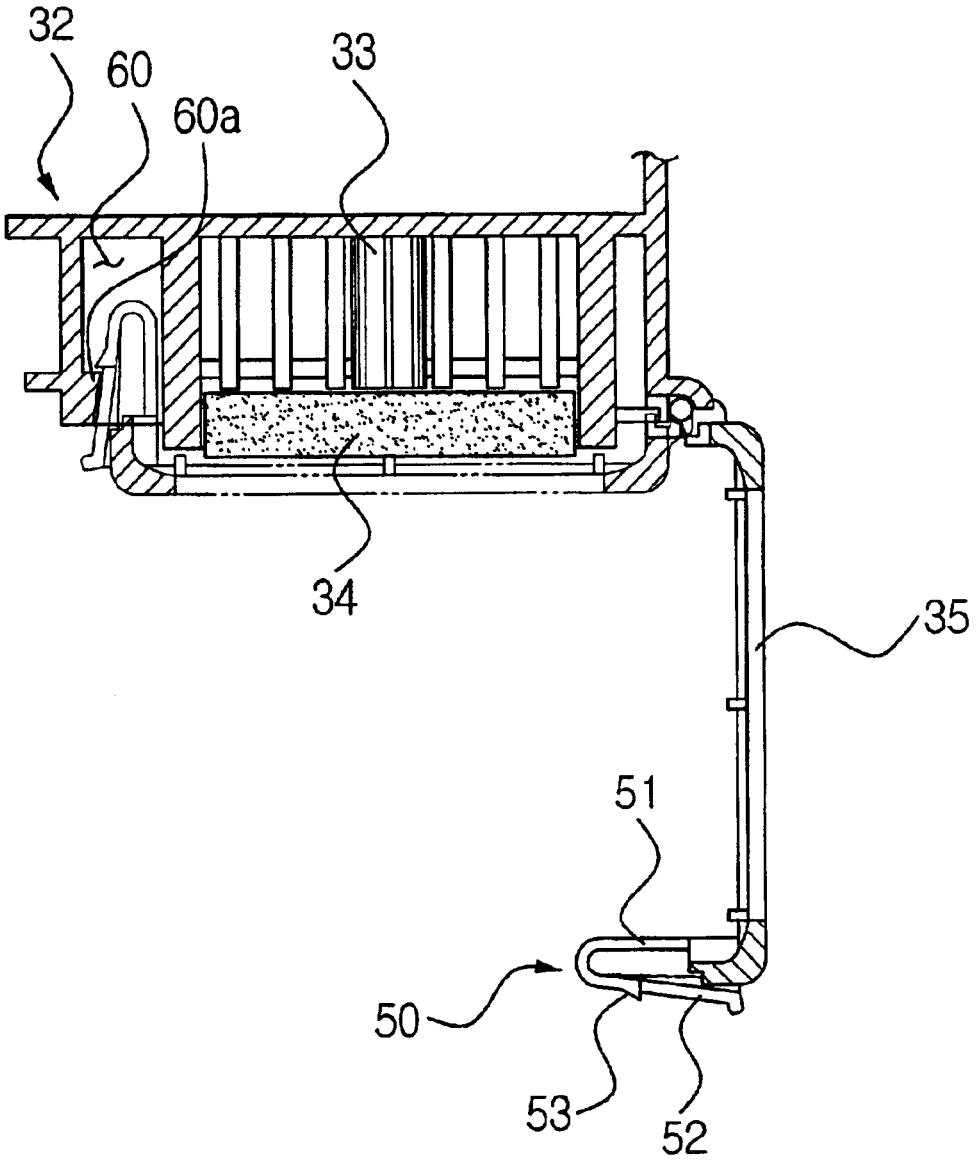
FIG. 6 is a sectional view taken approximately along a line VI—VI of FIG. 4.

FIG. 4 is a perspective view showing an air exhaust structure for an upright-type vacuum cleaner according to the preferred embodiment of the present invention. FIG. 5 is a view showing an enlarged part of FIG. 4 in greater detail. FIG. 6 is a sectional view taken approximately along a line VI—VI of FIG. 4. Elements having the same structure and function with the elements of the conventional upright-type vacuum cleaner are given the same reference numerals.

As shown in FIGS. 4 through 6, the air exhaust structure for the upright-type vacuum cleaner according to the preferred embodiment of the present invention comprises: a frame 32 having a duct 31 formed at a side of the cleaner body 10 in a lengthwise direction in order to communicate with the motor driving chamber 12; a support member 33 protruding to a predetermined dimension from an inside wall of the duct 31; a filter 34 for insertion into the duct 31; a filter cover 35 having a grill portion 35*a* disposed adjacent the frame 32 for rotation to allow the frame 32 to be opened and closed; and a removable means 40 for opening and closing the filter cover 35.

The removable means 40 includes a hook 50 integrally formed at a front end of the filter cover 35, and a locking hole 60 having a locking protrusion 60*a* disposed at the frame 32 placed at a position generally corresponding to the position of the hook 50.

As shown in FIG. 5, the hook 50 comprises: a fixing portion 51 extended in an inner direction from the filter cover 35; a flexible pressing portion 52 bent in a direction approximately 180° from the fixing portion 51 and extended outwardly from the filter cover 35; and a pair of protrusions 53 disposed at both sides of the flexible pressing portion 52 for providing a connection to the locking protrusion 60*a* (FIG. 6) of the locking hole 60.

The flexible pressing portion 52 is flexibly biased in a direction of opening of a free end in regard to the fixing portion 51. Thus, the filter cover 35 will be inhibited from opening by the discharging pressure of the air while a user is using the vacuum cleaner, since the protrusion 53 of the hook 50 and the locking protrusion 60*a* of the locking hole 60 are firmly engaged, when the discharging pressure of the air affects the filter cover 35 in the closing state of the filter cover 35. In other words, the filter cover 35 is firmly held in the closed position when the hook 50 is inserted into the locking hole 60 of the frame 32, and the protrusion 53 of the hook 50 is locked with the locking protrusion 60*a* of the locking hole 60.

To open the filter cover 35, the user slightly presses the flexible pressing portion 52 of the hook 50, and the protrusion 53 of the hook 50 is released from engagement with the locking protrusion 60*a* of the locking hole 60. Thus, the filter cover 35 is easily opened.

On the other hand, a cut away portion 54 can be formed in a bent portion of the fixing portion 51 of the hook 50 and the flexible pressing portion 52 in order to increase the elasticity of the flexible pressing portion 52 with respect to the fixing portion 51. Moreover, the preferred embodiment of the present invention has been described and illustrated having two hooks 50 and 50' and two locking holes 60 and 60' in FIG. 4, but one hook and one locking hole can also be used, as shown in FIG. 5.

In the air exhaust structure of the upright-type vacuum cleaner according to the present invention having the above elements, the air discharged to the motor driving chamber 12 is blown into the duct 31, and the air is again discharged to the outside through the filter 34 and the grill portion 35*a* of the filter cover 35. At this time, the dust and dirt included in the air is filtered at the filter 34. When the filter cover 35 is opened from the frame 32 for cleaning or changing of the filter 34 after the vacuum cleaner is used a long time, the user just presses the flexible pressing portion 52 of the hook 50 disposed at the filter cover 35. The protrusion 53 disposed at the flexible pressing portion 52 is flexibly engaged with the locking protrusions 60*a* of the locking hole 60 disposed at the frame 32 when the filter cover 35 is closed, thus the filter cover 35 is not easily opened since the filter cover 35 is not affected by the discharging pressure of the air. When the flexible pressing portion 52 is pressed in the closed state of the filter cover 35, the filter cover 35 can be easily opened as the protrusion 53 of the hook 50 is released from the flexible engagement with the locking protrusion 60*a* of the locking hole 60. In other words, great force is not required to pull the filter cover 35, in order to open the filter cover 35, unlike with the conventional upright vacuum cleaner.

As described so far, when the user pushes the filter cover 35 to close the filter cover 35 after cleaning and changing the filter 34 in the opened state of the filter cover 35, the closed state of the filter cover 35 is maintained, since the hook 50 of the filter cover 35 is inserted into the locking hole 60 of the frame 32, and the protrusion 53 of the hook 50 is flexibly locked with the locking protrusion 60*a* of the locking hole 60.

According to the above-described present invention, the closed state of the filter cover is maintained since the protrusion of the flexible pressing portion disposed at the hook of the filter cover is flexibly connected to and in engagement with the locking protrusion of the locking hole disposed at the frame, thus the filter cover is not easily opened by the discharging pressure of the air. In addition, the opening and the closing of the filter cover is easily operated, as the filter cover is opened by releasing the locking state of the protrusion of the flexible pressing portion and the locking protrusion of the locking hole, with the simple method of pressing the flexible pressing portion of the hook. In other words, according to the present invention, the opening and the closing of the filter cover is very easy, while the filter cover is not unintentionally opened by the force of the discharged air while the user is using the vacuum cleaner. Therefore, the convenience of the vacuum cleaner will be improved.

So far, the preferred embodiment of the present invention has been illustrated and described. However, the present invention is not limited to the preferred embodiment described here, and someone skilled in the art can modify the present invention without distorting the point of the present invention claimed in the following claims.

What is claimed is:

1. An air exhaust structure for an upright-type vacuum cleaner comprising:

a frame having a duct formed at a side of the cleaner body in order to communicate with the motor driving chamber;

a support member protruded from an inside wall of the duct;

a filter;

a filter cover having a grill portion disposed at the frame; and at least one removable means for opening and closing the filter cover, wherein the removable means includes at least one hook formed at a front end of the filter cover, the hook including a fixing portion extended from the filter cover, a flexible pressing portion bent in a direction approximately 180° from the fixing portion, and a pair of protrusions disposed at both sides of the flexible pressing portion for engagement with the locking protrusion of the locking hole; and a locking hole having a locking protrusion disposed at the frame placed at a position corresponding to the position of the hook.

2. The air exhaust structure of the upright-type vacuum cleaner of claim 1, wherein at least two hooks are disposed at a front end of the filter cover.

3. The air exhaust structure for the upright-type vacuum cleaner of claim 1, wherein a cut away portion is formed at the fixing portion and a bent portion of the flexible pressing portion in order to increase the elasticity of the flexible pressing portion.

4. The air exhaust structure for the upright-type vacuum cleaner of claim 1, wherein one side of the filter cover is rotatably attached to the frame by a hinge.

* * * * *